United States Patent [19]

Schaffer et al.

[11] 4,253,259

[45] Mar. 3, 1981

[54] CARPET DISPLAY SYSTEM

[75] Inventors: Daniel I. Schaffer; Carl R. Elsinger, both of New York, N.Y.

[73] Assignee: Commercial Affiliates, Inc., New York, N.Y.

[21] Appl. No.: 50,079

[22] Filed: Jun. 19, 1979

[51] Int. Cl.[3] ..... G09F 7/00

[52] U.S. Cl. ..... 40/492; 40/124.1; 434/75; 434/367

[58] Field of Search ..... 40/492, 124.1, 2 R, 40/1, 376; 35/55, 49, 50, 52, 53

[56] References Cited

U.S. PATENT DOCUMENTS

| | | | |
|---|---|---|---|
| 1,045,372 | 11/1912 | Cohen | 35/55 X |
| 2,135,590 | 11/1938 | Moses | 35/53 |
| 2,177,914 | 10/1939 | Steinthal | 35/53 |
| 2,786,281 | 3/1957 | Kramer et al. | 35/55 |
| 3,008,247 | 11/1961 | Gaumond | 35/50 |
| 3,530,593 | 9/1970 | Howard | 35/55 |
| 3,762,985 | 10/1973 | Chaitman | 35/55 X |
| 3,844,864 | 10/1974 | Glover et al. | 35/55 X |
| 3,950,871 | 4/1976 | Rege | 40/492 |
| 4,104,809 | 8/1978 | Day et al. | 40/492 X |

*Primary Examiner*—John F. Pitrelli
*Assistant Examiner*—G. Lee Skillington
*Attorney, Agent, or Firm*—Holland, Armstrong, Wilkie & Previto

[57] ABSTRACT

A portable carpet display system in which the colors of a particular line of carpeting are displayed on a single card which has the specifications of that line of carpeting on the reverse side, with a plurality of said cards being mounted together.

4 Claims, 5 Drawing Figures

CARPET DISPLAY SYSTEM

The present invention relates to a carpet display system and more particularly to an improved portable carpet color and texture guide for displaying samples.

Carpets are often displayed by assembling small samples of the carpets together. The samples show the various colors of a particular line of carpeting. These samples are sometimes displayed in a catalogue book which has the color samples of a particular line of carpeting affixed to the various pages of the catalogue book and the pages would also give the specifications of that particular line of carpeting.

Samples of the colors of a particular line of carpeting may also be displayed by assembling them together with a chain or similar fastening device. A separate card may be mounted on the chain listing the specifications of the carpeting or this information may appear on the rear face of the samples.

It will be seen that with existing display systems, a salesman would have to carry numerous catalogue books or numerous chain display sets in order to be able to show a prospective customer several lines of carpeting. This is a time-consuming and cumbersome operation for a salesman.

The present invention avoids these drawbacks and has for one of its objects the provision of an improved carpet display system in which a plurality of lines can be placed together in an easily portable display assembly.

Another object of the present invention is the provision of an improved carpet display system which avoids the necessity of having separate catalogue books or chain sets for each line of carpeting.

Another object of the present invention is the provision of an improved portable carpet display system which is compact and easy to carry.

Other and further objects of the invention will be obvious upon an understanding of the illustrative embodiment about to be described, or will be indicated in the appended claims, and various advantages not referred to herein will occur to one skilled in the art upon employment of the invention in practice.

A preferred embodiment of the invention has been chosen for purposes of illustration and description and is shown in the accompanying drawings forming a part of the specification wherein.

Figure 1:
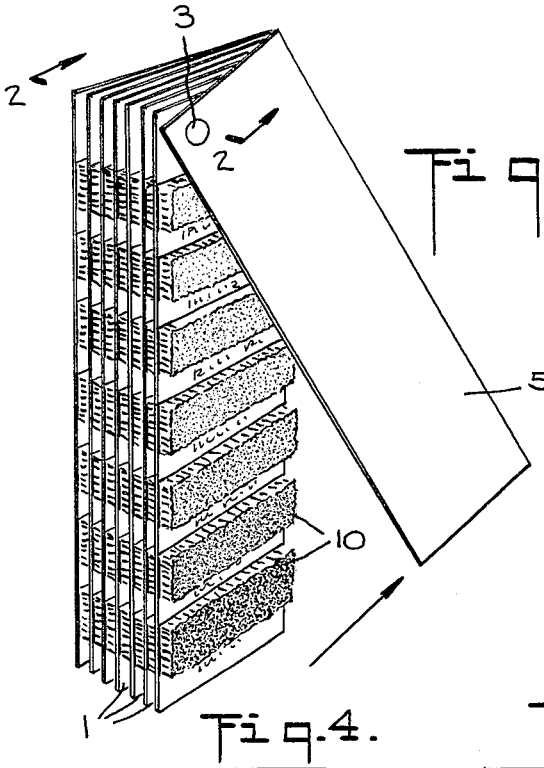
FIG. 1 is a perspective view of the improved carpet color and texture guide embodying the present invention.
Figure 2:
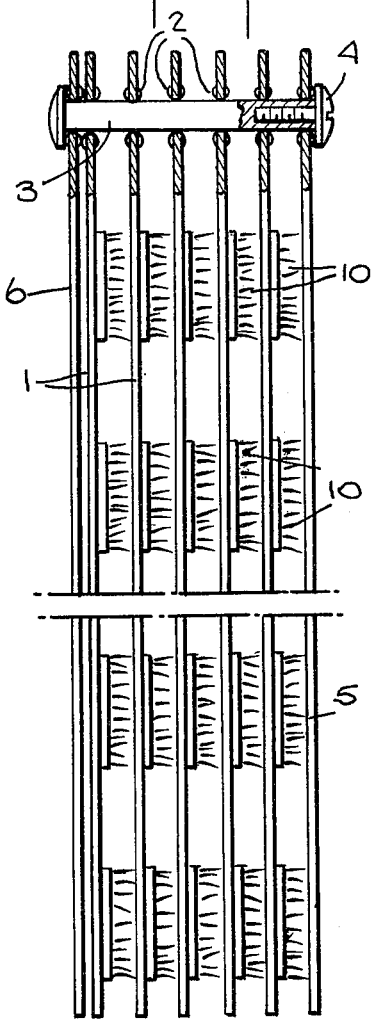
FIG. 2 is an end view thereof, partly in section, taken along line 2—2 of FIG. 1.
Figure 4:
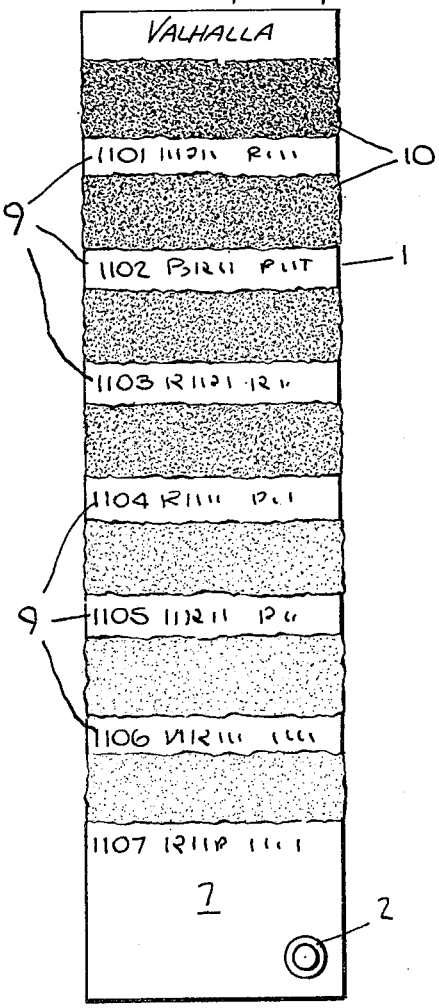
FIG. 4 is an elevational view showing the front face of a sample card.
Figure 5:
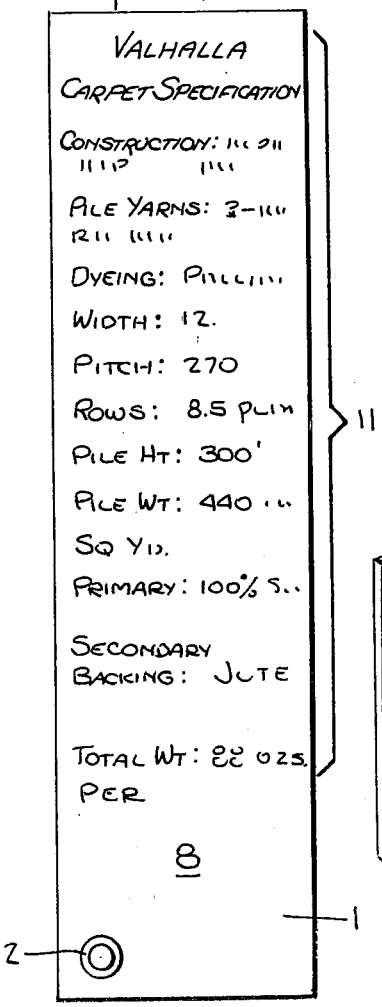
FIG. 5 is an elevational view showing the rear face of the sample card of FIG. 4.
Figure 3:
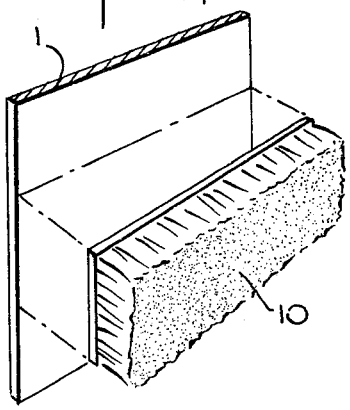
FIG. 3 is an exploded fragmentary perspective view showing a carpet sample attached to a card.

Referring more particularly to the drawings, the present invention comprises a plurality of sample cards 1 each of which has a grommet-reenforced opening 2 at one corner. The samples cards 1 are held together by any well known holding element, such as the threaded element assembly 3-4, which extends through the openings 2 of all the sample cards 1 so that the sample cards are pivotally mounted relative to each other. Front and rear cover cards 5 and 6 may also be pivotally affixed to the threaded element assembly 3-4 in order to complete the construction.

Each card 1 is preferably rectangularly shaped and is preferably small enough to be portable. Each card 1 has a plurality of color samples 10 of a particular line adhered thereto on its front face 7. These color samples 10 may be in the form of a small samples adhered or otherwise attached to the front face 7 of the card 1. The samples 10 are preferably placed above each other in spaced relationship to each other and preferably extend across the entire face of the card 1. The name and/or number 9 of the color of that particular sample may appear immediately below or above the space for a particular sample 10. Since these color samples 10 are small it is possible to display all or most of the color samples 10 of a particular line of carpeting on a single card 1.

On the rear face 8 of the card 1 there is imprinted at 11 the specifications and other data for that particular line of carpeting, such as the width, construction, etc.

Any number of these cards, each with individual color samples 10 and specifications 11, may be assembled together by the threaded element assembly 3-4. Hence, a single, portable sample color chart is provided by the present invention may be used by salesman to display numerous lines of carpeting with the color samples of each line and the specifications pertaining to that line of carpeting.

It will be seen that the present invention provides an improved carpet display system in which a plurality of lines can be placed together in an easily portable display assembly which avoids the necessity of having separate catalogue books or chain sets for each line of carpeting and which is compact and easy to carry.

As many and varied modifications of the subject matter of this invention will become apparent to those skilled in the art from the detailed description given herein above, it will be understood that the present invention is limited only as provided in the claims appended hereto.

The embodiments of the invention in which an exclusive property or privilege is claimed are defined as follows:

1. A sample display system comprising a plurality of display cards, pivot means for assembling the display cards together so that the display cards are pivotally mounted so as to be individually movable relative to each other, a plurality of carpet samples on one face of a display card and informational data on said display card relating to the specifications of said samples, said samples on a display card being related to each other, identifying data for each sample being located adjacent the samples, the specifications of said samples being on the reverse face of said display card, a cover card being provided for said display system, the samples being mounted on the front face of each display card and located one above the other in spaced relationship to each other, said cards being spaced thickness-wise from each other and being in superimposed relationship to each other, the samples on each display card having a predetermined thickness which substantially fills the space between the display card on which the samples are mounted and the next superimposed card, the said cards and samples substantially filling the entire thickness of the display system whereby there is no substantial thickness-wise movement between the cards.

2. A display system as claimed in claim 1, wherein said display cards are substantially rectangular and are pivotly mounted to each other at one corner thereof.

3. A display system as claimed in claim 2, wherein said pivot mounting comprises a threaded assembly which permits the display cards to be assembled together.

4. A display system as claimed in claim 3, wherein the width of said samples is approximately the same as the width of said display cards.

* * * * *